US009315039B2

(12) United States Patent
Yoshida

(10) Patent No.: US 9,315,039 B2
(45) Date of Patent: Apr. 19, 2016

(54) LIQUID SUPPLYING DEVICE, DROPLET DISCHARGE DEVICE, AND IMAGE FORMING APPARATUS

(71) Applicant: Satoru Yoshida, Kanagawa (JP)

(72) Inventor: Satoru Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/564,326

(22) Filed: Dec. 9, 2014

(65) Prior Publication Data

US 2015/0165783 A1 Jun. 18, 2015

(30) Foreign Application Priority Data

Dec. 13, 2013 (JP) ..... 2013-258605

(51) Int. Cl.
*B41J 2/175* (2006.01)

(52) U.S. Cl.
CPC ..... *B41J 2/17596* (2013.01); *B41J 2/175* (2013.01); *B41J 2/17509* (2013.01)

(58) Field of Classification Search
CPC ..... B41J 2/175; B41J 2/1752; B41J 2/17509; B41J 2/17513; B41J 2/17596
USPC ..... 347/84–85
See application file for complete search history.

(56) References Cited

U.S. PATENT DOCUMENTS

| | | | | |
|---|---|---|---|---|
| 4,914,453 | A * | 4/1990 | Kanayama et al. | 347/86 |
| 7,992,955 | B2 * | 8/2011 | Takata | 347/18 |
| 8,147,044 | B2 * | 4/2012 | Yokouchi | 347/85 |
| 8,619,303 | B2 * | 12/2013 | Miura | 358/1.15 |

FOREIGN PATENT DOCUMENTS

JP 2002-355992 12/2002

* cited by examiner

*Primary Examiner* — Bradley Thies
(74) *Attorney, Agent, or Firm* — Cooper & Dunham LLP

(57) ABSTRACT

A liquid supplying device includes a pump, an operation member, an entry channel, and a shutter. The pump includes a deformable liquid container to store liquid and is configured to suck liquid from a liquid storage unit to the liquid container by increasing volume of the liquid container and supply the liquid from the liquid container to a liquid supply target by decreasing the volume of the liquid container. The operation member is operated by a user. The entry channel connects the liquid storage unit and the liquid container. The shutter moves with movement of the operation member to shut the entry channel.

11 Claims, 14 Drawing Sheets

LIQUID SUPPLYING DEVICE, DROPLET DISCHARGE DEVICE, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-258605, filed on Dec. 13, 2013, in the Japan Patent Office, the entire disclosure of which is hereby incorporated by reference herein.

BACKGROUND

1. Technical Field

Embodiments of the present disclosure relate to a liquid supplying device to supply liquid, such as ink, stored in a liquid storage unit to a liquid supply target and an image forming apparatus, such as a printer, a copier, or a facsimile machine, including the liquid supplying device.

2. Description of the Related Art

A liquid supplying device may have a pump called a diaphragm pump including a first check valve and a second check valve arranged at an inlet, through which liquid is supplied into a diaphragm (liquid container), and an outlet, through which liquid is discharged from the diaphragm, respectively. The diaphragm includes a compression coil spring (hereinafter, referred to as "spring") to urge the diaphragm outward. When the diaphragm is expanded outward by the urging force of the spring, the internal volume of the diaphragm increases. The diaphragm pump has a pressing member to press the diaphragm inward from the outside of the diaphragm against the urging force of the spring.

When the pressing member turns into a pressing state in which the pressing member pressing the diaphragm from the outside, the volume of the diaphragm decreases. As a result, the internal pressure of the diaphragm rises, thus discharging liquid from the outlet of the diaphragm via the second check valve. By contrast, when the pressing state of the pressing member is released and turned into a non-pressing state, the volume of the diaphragm is raised by the spring of the diaphragm. As a result, the internal pressure of the diaphragm falls, thus supplying (sucking) liquid from the inlet of the diaphragm via the first check valve. For example, such a diaphragm pump is employed as a liquid feeding unit to feed ink as liquid from a main tank (liquid storage unit) to a sub tank (liquid supply target) in an inkjet recording apparatus.

SUMMARY

In at least one embodiment of this disclosure, there is provided a liquid supplying device including a pump, an operation member, an entry channel, and a shutter. The pump includes a deformable liquid container to store liquid and is configured to suck liquid from a liquid storage unit to the liquid container by increasing volume of the liquid container and supply the liquid from the liquid container to a liquid supply target by decreasing the volume of the liquid container. The operation member is operated by a user. The entry channel connects the liquid storage unit and the liquid container. The shutter moves with movement of the operation member to shut the entry channel.

In at least one embodiment of this disclosure, there is provided an image forming apparatus including

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 8 is a front view of a channel plate constituting an entry channel according to at least one embodiment of this disclosure, seen from a side to which an ink cartridge is connected, according to;

Figure 1:
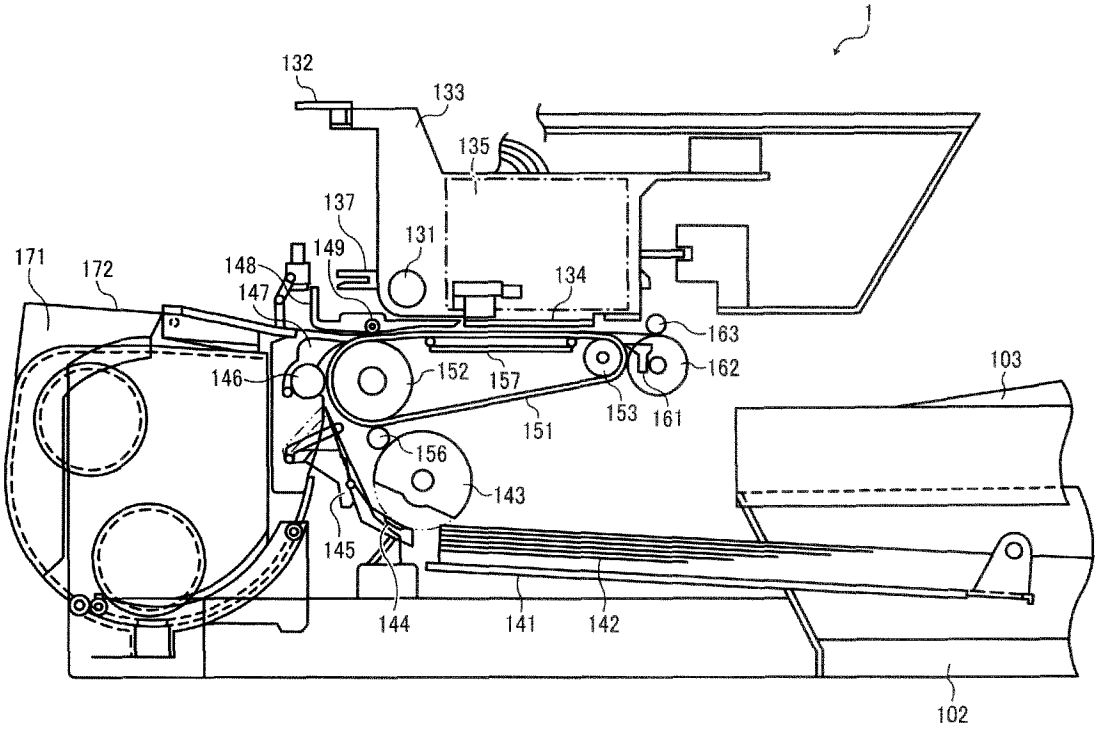
FIG. 1 is a side view of a mechanical part of an inkjet recording apparatus as an image forming apparatus according to at least one embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

In a liquid supplying device of an image forming apparatus, when a liquid storage unit (main tank or ink cartridge) becomes empty of liquid, such as ink, the empty liquid storage unit connected to an inlet of a diaphragm via a first check valve is removed for replacement and then a new liquid storage unit is installed. When the liquid storage unit becomes empty of liquid, liquid in the liquid storage unit is not supplied into the diaphragm. Even when a pressing member turns into a non-pressing state, the volume of the diaphragm does not sufficiently increase. Then, when the empty liquid storage unit is removed, the inlet of the diaphragm is opened to (communicated with) ambient air. Accordingly, when the empty liquid storage unit is removed with the pressing member being in the non-pressing state, the pressing force of the pressing member does not act on the diaphragm. As a result, the volume of the diaphragm increases, thus sucking air from the inlet into the diaphragm via the first check valve. If air is introduced into the diaphragm and a diaphragm pump is activated with a new liquid storage unit installed, air may move with liquid from the diaphragm to the liquid supply target and cause a failure in use of liquid in the liquid supply target and downstream thereof. For example, an inkjet recording apparatus may cause a failure, such as non ink discharge from a print head. Therefore, it is necessary to prevent air from being introduced into the diaphragm when an empty liquid storage unit is removed.

In light of such circumferences, at least one embodiment of this disclosure provides a liquid supplying device capable of preventing, at relatively low cost, introduction of air into a liquid container of a pump when an empty liquid storage unit is removed, and an image forming apparatus including the liquid supplying device.

Referring now to the drawings, embodiments of the present disclosure are described below. In the drawings for explaining the following embodiments, the same reference codes are allocated to elements (members or components) having the same function or shape and redundant descriptions thereof are omitted below.

Below, an inkjet recording apparatus having a liquid discharge head is described as an example of an image forming apparatus according to an embodiment of the present disclosure.

Figure 2:
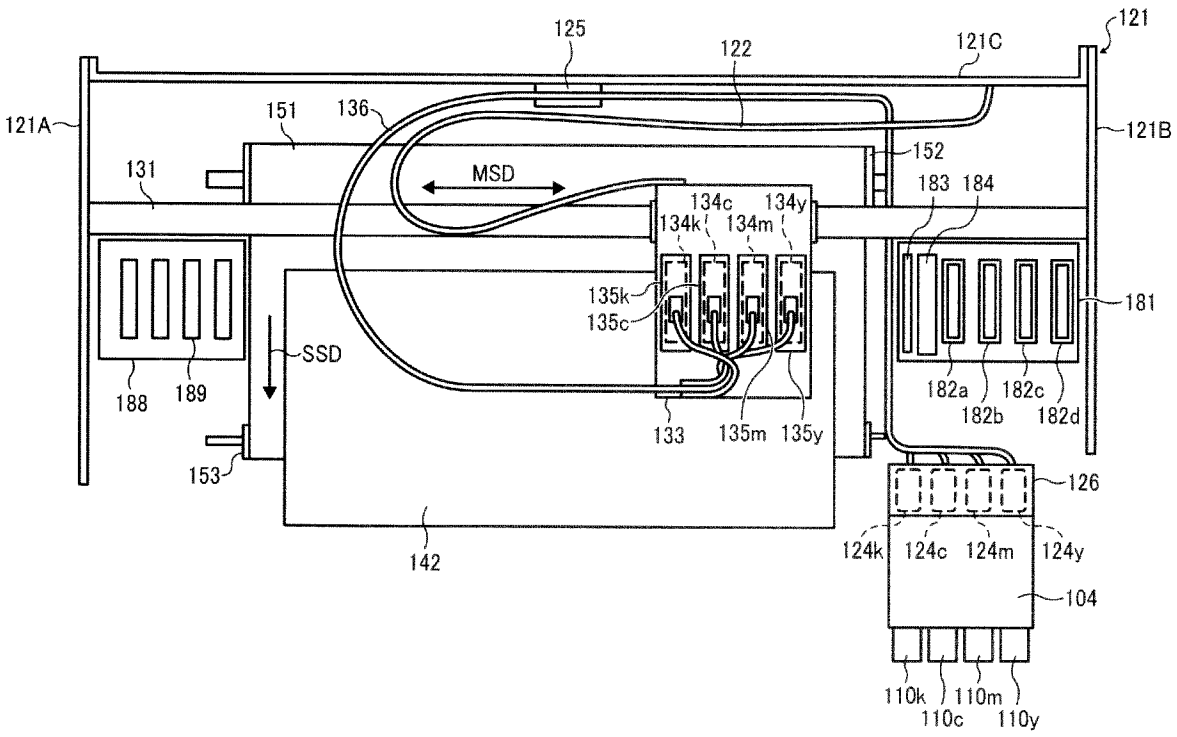
FIG. 2 is a plan view of the mechanical part of the inkjet recording apparatus illustrated in FIG. 1.

FIG. 1 is a side view of a mechanical section of the inkjet recording apparatus according to at least one embodiment of this disclosure. FIG. 2 is a plan view of a part of the inkjet recording apparatus of FIG. 1.

As shown in FIGS. 1 and 2, the inkjet recording apparatus 1 includes a left-side plate 121A and a right-side plate 121B that form a frame 121. In the mechanical section of the inkjet recording apparatus 1, a carriage 133 is slidably held with a guide rod 131 and a stay 132 serving as guide members laterally bridging between the left-side plate 121A and the right-side plates 121B. The carriage 133 is reciprocally moved for scanning in a main scanning direction indicated by arrow MSD in FIG. 2. A main scanning motor moves the carriage 133 for scanning through a timing belt in a main scanning direction of the carriage indicated by arrow MSD in FIG. 2.

In FIGS. 1 and 2, the carriage 133 mounts four print heads 134*k*, 134*c*, 134*m* and 134*y* serving as liquid discharge heads to discharge ink droplets of respective colors of black (K), cyan (C), magenta (M), and yellow (Y). The print heads 134*k*, 134*c*, 134*m* and 134*y* (collectively referred to as the print heads 134 unless colors specified) are arrayed in a line extending in a direction perpendicular to the main scanning direction MSD so as to discharge ink droplets downward. In some embodiments, the inkjet recording apparatus 1 includes a single print head including nozzle rows to discharge ink droplets of multiple colors. In some embodiments, the inkjet recording apparatus 1 includes multiple print heads including nozzle rows to discharge ink droplets of multiple colors.

As a pressure generator that generates pressure to eject droplets, inkjet heads constituting the print heads 134 employ, for example, piezoelectric actuators such as piezoelectric elements, thermal actuators that generate film boiling of liquid (ink) using electro/thermal converting elements such as heat-generation resistant bodies to cause a phase change, shape-memory-alloy actuators that change metal phase by a temperature change, or electrostatic actuators that generate pressure by electrostatic force.

The carriage 133 mounts the head tanks 135*k*, 135*c*, 135*m*, and 135*y* to supply respective color inks to the print heads 134*k*, 134*c*, 134*m* and 134*y* The different color inks are supplied and refilled from the ink cartridges 110*k*, 110*c*, 110*m*, and 110*y* to the head tanks 135*k*, 135*c*, 135*m*, and 135*y* via flexible ink supply tubes 136. The ink cartridges 110*k*, 110*c*, 110*m*, and 110*y* serving as liquid storage units are mounted in an ink-cartridge mount 104. On the ink-cartridge mount 104 are mounted ink supplying devices 124*k*, 124*c*, 124*m*, and 124*y* (hereinafter collectively referred to as "ink supplying devices 124" unless distinguished) serving as liquid supplying devices that feed ink from the ink cartridges 110. The ink supply tubes 136 are held at a midway with a stopper 125 on a rear plate 121C that constitutes part of the frame 121.

The inkjet recording apparatus 1 includes a sheet feed unit to feed sheets 142 stacked on a sheet stack portion (pressure plate) 141 of a sheet feed tray 102 illustrated in FIG. 1. The sheet feed unit includes a sheet feed roller 143 having, e.g., a semicircular shape that separates the sheets 142 from the sheet stack portion 141 and feeds the sheets 142 sheet by sheet and a separation pad 144 that is disposed facing the sheet feed roller 143. The separation pad 144 includes a material of a high friction coefficient and biased (urged) toward the sheet feed roller 143. In the following, the material of the recording medium is not limited to paper, and for example, includes yarn, fibers, textile, leather, metal, plastics, glass, wood, and ceramics.

To feed the sheets 142 from the sheet feed unit to a position below the print heads 134, the inkjet recording apparatus 1 includes a first guide 145 to guide the sheets 142, a counter roller 146, a conveyance guide 147, and a pressing member 148 including a leading-edge press roller 149.

The inkjet recording apparatus 1 also includes a conveyance belt 151 serving as a conveyor to electrostatically adsorb the sheet 142 thereon and convey the sheet 142 to a position opposing the print heads 134. The conveyance belt 151 is an endless belt that is looped between a conveyance roller 152 and a tension roller 153 so as to circulate in a belt conveyance direction, in other words, a sub-scanning direction indicated by arrow SSD in FIG. 2. The inkjet recording apparatus 1 further includes a charge roller 156 serving as a charger to charge a surface of the conveyance belt 151. The charge roller 156 is disposed so as to contact a surface layer of the conveyance belt 151 and rotate in accordance with the circulation of the conveyance belt 151. On the back side of the conveyance belt 151 is disposed a second guide member 157 at a position corresponding to a print area of the print heads 134. The conveyance roller 152 is rotated by a sub-scanning motor via a timing roller, so that the conveyance belt 151 circulates in the belt conveyance direction SSD.

The inkjet recording apparatus 1 also includes a paper ejection unit to eject the sheet 142 having an image recorded by the print heads 134. The paper ejection unit includes a separation claw 161 that separates the sheet 142 from the conveyance belt 151, a first paper ejection roller 162, a second paper ejection roller 163, and a paper ejection tray 103 disposed below the first paper ejection roller 162.

For the inkjet recording apparatus 1, a duplex unit 171 is detachably mounted on a rear portion of an apparatus body 101. When the conveyance belt 151 rotates in a reverse direction to return the sheet 142, the duplex unit 171 receives the sheet 142 and turns the sheet 142 upside down to feed the sheet 142 between the counter roller 146 and the conveyance belt 151. At a top face of the duplex unit 171 is formed a bypass tray 172.

As illustrated in FIG. 2, a maintenance assembly 181 is disposed in a non-printing area that is located at one end in the main scanning direction of the carriage 133. The maintenance assembly 181 a recovery unit to maintain and recover nozzle conditions of the print heads 134. The maintenance assembly 181 includes caps 182*a* to 182*d* (hereinafter collectively referred to as "caps 182" unless distinguished) that cover the nozzle faces of the print heads 134, a wiper blade 183 serving as a blade member to wipe the nozzle faces of the print heads 134, and a first dummy discharge receptacle 184 to receive ink droplets discharged to remove thickened ink during dummy discharge. In FIG. 2, the cap 182*a* is used for ink suction and moisture retention while the other caps 182*b* to 182*d* for moisture retention. Waste liquid of recording liquid expelled in maintenance-and-recovery operation of the maintenance assembly 181, ink discharged to the caps 182, ink adhering to the wiper blade 183 and wiped with a wiper cleaner 185, and ink discharged to the first droplet receptacle 184 are stored in a waste tank.

As illustrated in FIG. 2, a second dummy discharge receptacle 188 is disposed at a non-print area on the other end in the main scanning direction of the carriage 133. The second dummy discharge receptacle 188 receives ink droplets that are discharged to remove thickened ink during, e.g., recording operation. The second dummy discharge receptacle 188 has openings 189 arranged in parallel with a direction in which the rows of nozzles of the print heads 134 are arranged in lines.

In the inkjet recording apparatus 1 having the above-described configuration, the sheets 142 are separated one by one from the sheet feed tray 102, fed in a substantially vertically upward direction, guided along the first guide 145, and conveyed between the conveyance belt 151 and the counter roller 146. A leading edge of the sheet 142 is guided with the conveyance guide 147 and pressed against the conveyance belt 151 by the leading-edge press roller 149 to turn a transport direction of the sheet 142 by substantially 90°. At this time, an alternating current (AC) bias supply unit alternately supplies positive and negative voltages to the charge roller 156 so that the conveyance belt 151 is charged in an alternating voltage pattern, that is, an alternating band pattern having positively-charged areas and negatively-charged areas at a predetermined width in the sub-scanning direction, which is a circulation direction of the conveyance belt 151. When the sheet 142 is fed onto the conveyance belt 151 alternatively charged with positive and negative charges, the sheet 142 is adsorbed on the conveyance belt 151 and conveyed in the sub-scanning direction by circulation of the conveyance belt 151.

By driving the print heads 134 in response to image signals while moving the carriage 133 in the main scanning direction MSD in accordance with information on the position of the carriage 133 detected with a linear encoder 137, ink droplets are ejected onto the sheet 142, which is stopped below the print heads 134, to form one line of a desired image. Then, the sheet 142 is fed by a certain distance and the print heads 134 discharge ink droplets to record another band of the image. Receiving a signal indicating that the image has been recorded or the rear end of the sheet 142 has arrived at the recording area, the print heads 134 finish the recording operation and the sheet 142 is ejected to the paper ejection tray 103.

In waiting for the next recording (printing) operation, the carriage 133 moves to the maintenance assembly 181 and the caps 182 cover the print heads 134. Thus, the caps 182 maintains the moisture of the nozzles to prevent a discharge failure due to ink drying. A suction pump sucks recording liquid from the nozzles with the print heads 134 covered with the caps 182, which is referred to as "nozzle suction" or "head suction". Thus, the recovery operation is performed to remove thickened recording liquid or air bubbles. Further, before or during a recording operation, the above-described dummy discharge is performed to discharge ink for maintenance that is not used for the recording, thus maintaining a stable discharging performance of the print heads 134.

A configuration of an ink supply pump unit is described with reference to FIGS. 3 and 4.

Figure 3:
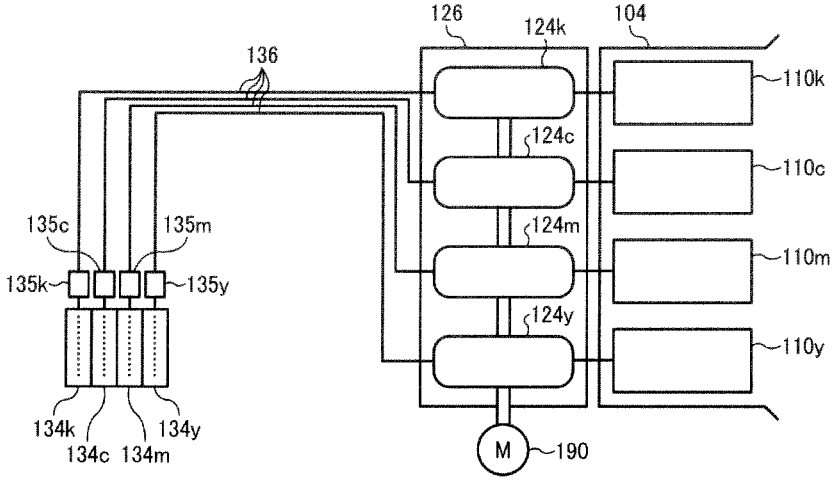
FIG. 3 is a schematic view of a configuration of an ink supply pump unit according to at least one embodiment of this disclosure.

FIG. 3 is a schematic view of a configuration of an ink supply pump unit according to at least one embodiment of this disclosure. The ink supplying devices 124*k*, 124*c*. 124*m*, and 124*y* supply and replenish respective color inks from the ink cartridges 110*k*, 110*c*, 110*m*, and 110*y* to the head tanks 135*k*, 135*c*, 135*m*, and 135*y*, respectively, via flexible ink supply tubes 136. The ink cartridges 110*k*, 110*c*, 110*m*, and 110*y* are mounted on the ink-cartridge mount 104. As illustrated in FIG. 3, the ink supplying devices 124*k*, 124*c*. 124*m*, and 124*y* are stored in device cases 126*k*, 126*c*, 126*m*, and 126*k*, respectively, and are driven with a drive motor 190 serving as a common drive source to supply respective color inks.

Figure 4A:
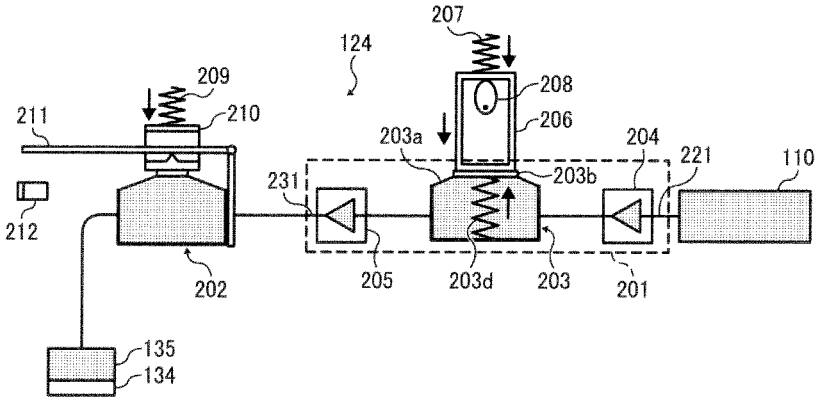
FIGS. 4A and 4B are schematic views of a configuration of an ink supplying device as a liquid supplying device according to at least one embodiment of this disclosure.
Figure 4B:
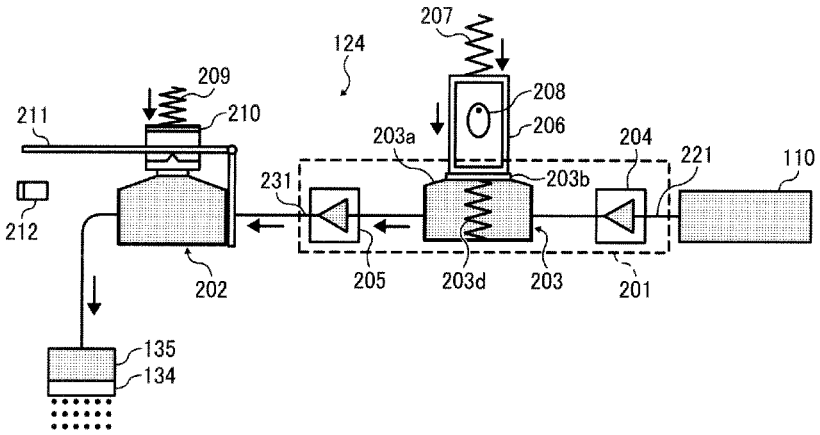

FIGS. 4A and 4B are schematic views of a configuration of the ink supplying device 124 according to at least one embodiment of this disclosure. In FIGS. 4A and 4B, the ink supplying device 124 includes a diaphragm pump 201 and a pressure buffer 202. The diaphragm pump 201 includes a pressurizing pump 203, a first check valve 204, and a second check valve 205. The first check valve 204 and the second check valve 205 are disposed upstream and downstream, respectively, from the pressurizing pump 203. In FIGS. 4A and 4*b*, the first check valve 204 is disposed at an entry channel 221 that connects an ink cartridge 110 to the pressurizing pump 203, and the second check valve 205 is disposed at an exit channel 231 that connects the pressurizing pump 203 to a head tank 135 via the pressure buffer 202. The pressurizing pump 203 includes a diaphragm 203*a*, a pump seat 203*b*, and an a spring 203*d*. The diaphragm 203*a* serves as a liquid container and includes a flexible member of a material, such as a flexible resin, allowing increase and decrease of an internal volume thereof. The pump seat 203*b* is provided inside the diaphragm 203*a*. The spring 203*d* is arranged to urge the diaphragm 203*a* via the pump seat 203*b* upward. A pressing member 206 is arranged to press the diaphragm 203*a* of the pressurizing pump 203 by a spring 207 downward from the upper side of the diaphragm 203*a*.

The pressure buffer 202 is provided to stabilize the liquid supply by the diaphragm pump 201 by applying a predetermined pressure to the head tank 135 through the ink supply tube 136. A pressing member 210 is mounted on an upper portion of the pressure buffer 202 and is pressed by a spring 209 disposed on top of the pressing member 210. The urging force of the spring 207 is greater than the urging force of the spring 209. The urging force of the spring 207 is greater than the urging force of the spring 203*d*.

Figure 6A:
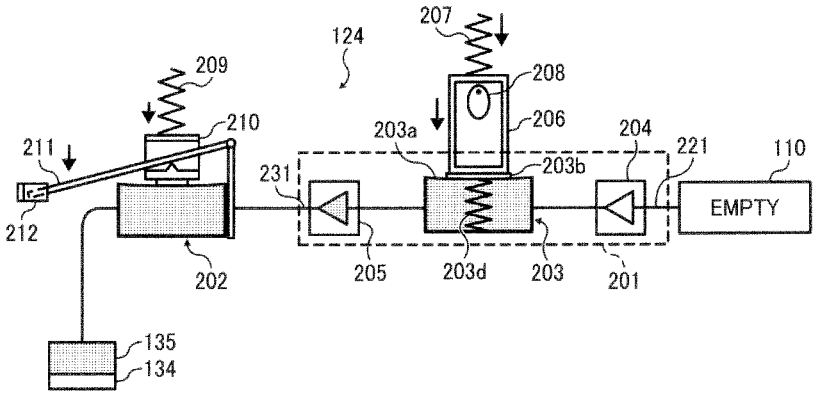
FIGS. 6A through 6C are schematic views of the liquid supplying device in operation with the ink cartridge empty of ink.
Figure 6B:
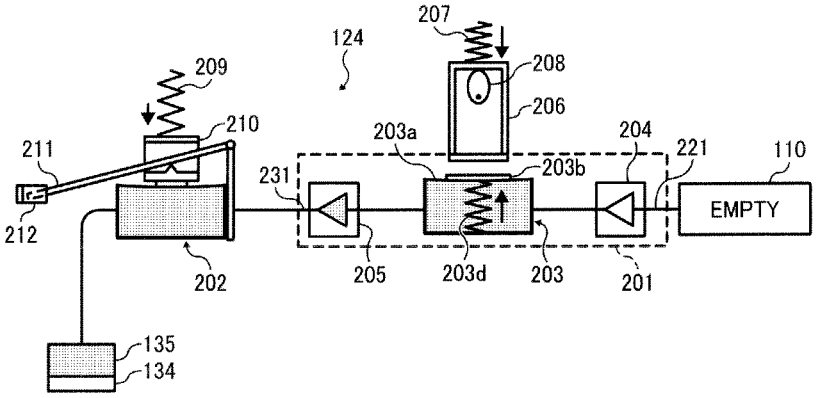
Figure 6C:
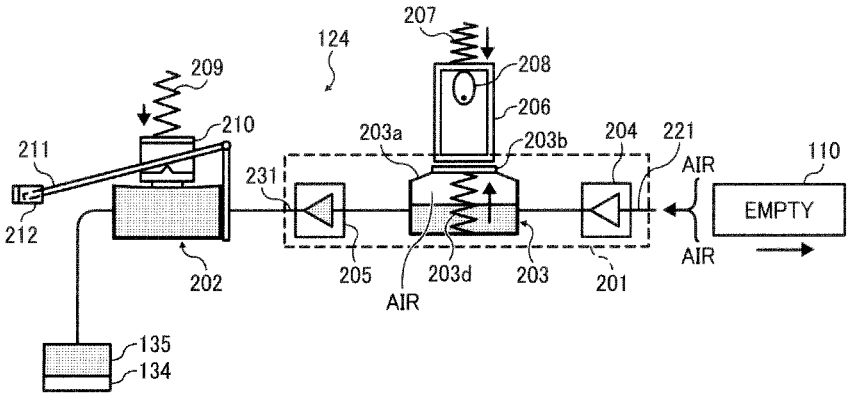

The pressing member 210 of the pressure buffer 202 has a substantially C-shape in cross section that opens at the front side and both lateral sides in FIGS. 4A and 4B. The pressing member 210 includes a stopper on an internal bottom surface of the pressing member 210 to contact an ink end detection feeler 211. The ink end detection feeler 211 is disposed to detect an ink end state of the ink cartridge 110. As shown in FIGS. 6A to 6C, if the volume of the pressure buffer 202 decreases and the position of the upper portion of the pressure buffer 202 moves down, the position of the pressing member 210 also moves down in accordance with the downward movement of the pressure buffer 202. By the downward movement of the pressing member 210, the ink end detection feeler 211 pivots around a shaft thereof, so that a tip of the ink end detection feeler 211 is lowered. An optical sensor 212 is disposed at a predetermined position at which the optical sensor 212 detects an ink end state of the ink cartridge. When the tip of the ink end detection feeler 211 passes through a detection area of the optical sensor 212 due to the lowering of the tip of the ink end detection feeler 211, the optical sensor 212 outputs a detection signal to a host device, thus allowing the host device to detect the ink end state of the ink cartridge.

Next, an ink supply operation of the ink supplying device according to at least one embodiment of this disclosure is described with reference to FIGS. 4A through 5C.

When the inkjet recording apparatus 1 is in operation, regardless of ink consumption, a motor continues rotating and thus a cam 208 continues rotating. The spring 207 urges the pressing member 206 downward in FIGS. 4A and 4B or toward a center of the diaphragm 203*a*. When the rotation angle of the cam 208 is at a state illustrated in FIG. 4A, a contact face of the cam 208 pushes up an upper face of an inner wall of the pressing member 206. Thus, the pressing member 206 moves in a direction away from the diaphragm 203*a*, in other words, upward in FIG. 4A against the urging force of the spring 207. As a result, the pressing member 206 rums into a non-pressing state.

When the cam 208 rotates from the state illustrated in FIG. 4A, the contact face of the cam 208 displaces in a direction away from the upper face of the inner wall of the pressing member 206, in other words, downward in FIG. 4A. As a result, the pressing member 206 becomes movable in a direction toward the center of the diaphragm 203, in other words, downward in FIG. 4A. In states illustrated in FIGS. 4A and 4B, the ink cartridge 110, the diaphragm 203, the pressure buffer 202, and the head tank 135 are substantially full with ink, and ink is not consumed. In such states, even if the cam 208 has a rotation angle illustrated in FIG. 4B and the pressing member 206 turns into a pressing state in which the pressing member 206 presses the diaphragm 203*a* with an urging force of the spring 207, the diaphragm 203*a* does not move in a direction to decrease the volume of the diaphragm 203.

Figure 5A:
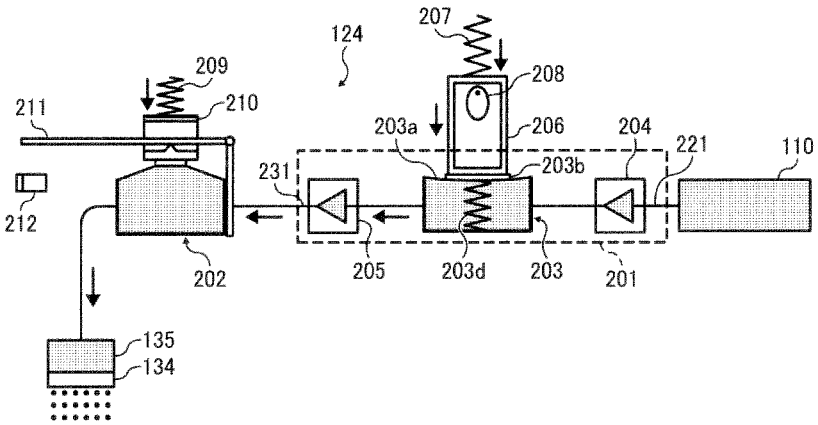
FIGS. 5A and 5B are schematic views of the liquid supplying device in operation with an ink cartridge containing ink.

As shown in FIG. 5A, if ink is discharged and consumed by the print head 134, the amount of ink in the head tank 135 decreases. In response to the decrease in the amount of ink, ink is supplied from the pressure buffer 202 to the head tank 135. When ink in the pressure buffer 202 decreases, the volume of the pressure buffer 202 decreases. When the pressing member 206 is in the pressing state illustrated in FIG. 5A, the pressing member 206 presses the diaphragm 203*a* with the spring 207 having an urging force greater than an urging force of the spring 209. Thus, ink in the diaphragm 203*a* is supplied to the pressure buffer 202 via the second check valve 205.

Unless the ink cartridge 110 becomes empty, such an operation prevents significant reduction in ink in the pressure buffer 202. Accordingly, the tip of the ink end detection feeler 211 at the pressure buffer 202 is not detected with the optical sensor 212. The urging force of the spring 207 and the urging force of the spring 209 are set so as not to affect meniscus in nozzles of the print head 134.

Figure 5B:
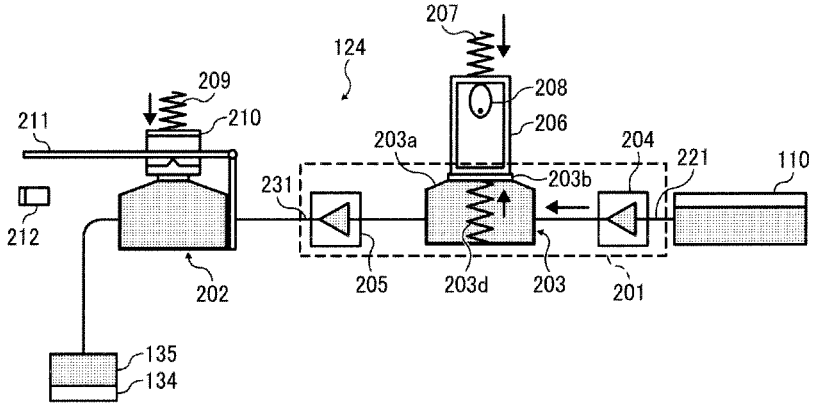

By contrast, when ink is supplied from the diaphragm 203*a* to the pressure buffer 202, the volume of the diaphragm 203*a* decreases. The spring 203*d* is provided inside the diaphragm 203*a* to urge the diaphragm 203*a* toward the outside of the diaphragm 203*a* (toward the pressing member 206). Accordingly, as illustrated in FIG. 5B, the pressing member 206 turns into a non-pressing state, and the volume of the diaphragm 203*a* increases. As a result, the diaphragm 203*a* turns into a negative pressure state, thus acting a suction force on ink. Thus, ink in the ink cartridge 110 is sucked into the diaphragm 203*a* via the first check valve 204.

As ink is consumed, as illustrated in FIG. 6A, finally, the ink cartridges 110 becomes empty of ink. When ink is consumed after the ink cartridge 110 becomes empty of ink, ink in the diaphragm 203*a* is continuously supplied to the pressure buffer 202. As a result, the volume of the diaphragm 203*a* decreases. However, the ink cartridge 110 runs short of ink to be sucked into the diaphragm 203*a*. Accordingly, as illustrated in FIG. 6B, even when the pressing member 206 turns into the non-pressing state, the diaphragm 203*a* is maintained at the negative pressure state. As a result, the volume of the diaphragm 203*a* does not increase, thus maintaining the volume of the diaphragm 203*a* at a decreased state.

When the optical sensor 212 detects the tip of the ink end detection feeler 211 and it is determined that at least one of the ink cartridges becomes empty, an ink end state is alerted to a user. Hence, a user can remove the empty ink cartridge 110 and mount a new ink cartridge 110 filled with ink for replacement.

In this replacement, if the stop position of the cam 208 is at a bottom dead center thereof as illustrated in FIG. 6A, the pressing member 206 is in the pressing state. Accordingly, the volume increase of the diaphragm 203*a* is restricted with the pressing member 206. Accordingly, even when the empty ink cartridge 110 is removed, the volume of the diaphragm 203*a* does not increase. As a result, a sucking force does not occur of introducing air from a connection port of the empty ink cartridge 110 via the first check valve 204.

However, if the stop position of the cam 208 is at a top dead center thereof as illustrated in FIG. 6B, the pressing member 206 is in the non-pressing state. As a result, the volume increase of the diaphragm 203*a* is not restricted with the pressing member 206. In such a state, if the empty ink cartridge 110 is removed, as illustrated in FIG. 6C, the volume of the diaphragm 203*a* increases. As a result, a sucking force occurs of introducing air from the connection port of the empty ink cartridge 110 via the first check valve 204, thus introducing air into the diaphragm 203. If air is introduced into the diaphragm 203*a*, air in the diaphragm 203*a* is supplied together with ink to the print head 134. As a result, some nozzles might not discharge ink, thus causing a defective image, or ink might be wasted to perform recovery operation to discharge such introduced air together with ink from the print head 134.

Figure 7A:
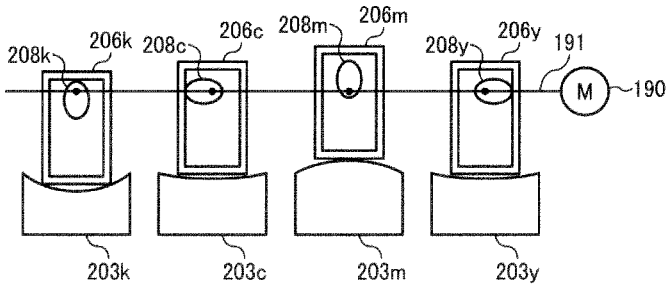
FIGS. 7A to 7C are schematic views of a cam drive mechanism of an ink supply device as a comparative example.
Figure 7B:
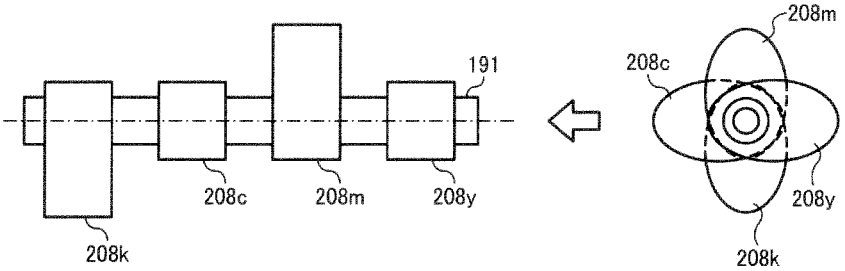
Figure 7C:
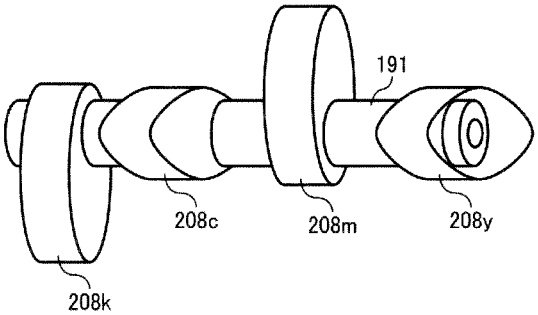

FIGS. 7A to 7C are diagrams of a cam drive mechanism of an ink supplying device according to a comparative example.

The ink supplying device according to the comparative example has an arrangement of the cam drive mechanism in which adjacent ones of four cams 208*k*, 208*c*, 208*m*, and 208*y* to drive four diaphragm pumps corresponding to four print heads for black, cyan, magenta, and yellow are shifted in rotational phase from each other by 90 degrees. In other words, adjacent ones of the four cams 208*k*, 208*c*, 208*m*, and 208*y* is secured to a circumferential surface of a rotation shaft 191 of a drive motor 190 so as to have different rotation angles from each other by 90 degrees in a cross section seen from an axial direction of the rotation shaft 191.

However, for the arrangement of the cam drive mechanism, for example, in a state illustrated in FIG. 7A, a pressing member 206*k* is in a pressing state in which the pressing member 206*k* presses a pressurizing pump 203*k* of the diaphragm pump corresponding to the cam 208*k*. Accordingly, since the volume increase of a diaphragm is restricted by the pressing member 206, removal of an empty ink cartridge 110*k* does not cause introduction of air into the diaphragm 203*ak*. However, for the pressurizing pumps 203*c*, 203*m*, and 203*y* of the diaphragm pumps corresponding to the other cams 208*c*, 208*m*, and 208*y*, the pressing members 206*c*, 206*m*, and 206*y* do not fully turn into pressing state. Accordingly, the pressing members 206*c*, 206*m*, and 206*y* do not restrict the volume increase of the diaphragms. In such sate, if the ink cartridge 110*c*, 110*m*, and 110*y* are removed, air is introduced into the diaphragms.

Here, it is conceivable to employ a configuration in which an empty ink cartridge to be removed can be identified and a drive motor 190 can be controlled so that the stop position of a cam 208 corresponding to the empty ink cartridge becomes a bottom dead point as illustrated in FIG. 6A. Such a configuration can prevent air from entering the corresponding pressurizing pump when the empty ink cartridge is removed. However, such a configuration needs a sensor to identify an empty ink cartridge to be removed, a sensor to sense a stop position of the cam 208, and a control mechanism to control the drive motor 190 in accordance with detection results of the sensors, thus resulting in cost increase. As a result, it is preferable to employ a more cost-effective configuration of preventing air from being introduced to a pressurizing pump when an empty ink cartridge is removed.

Next, a configuration and operation of a liquid supplying device according to at least one embodiment of this disclosure is described below.

Figure 8:
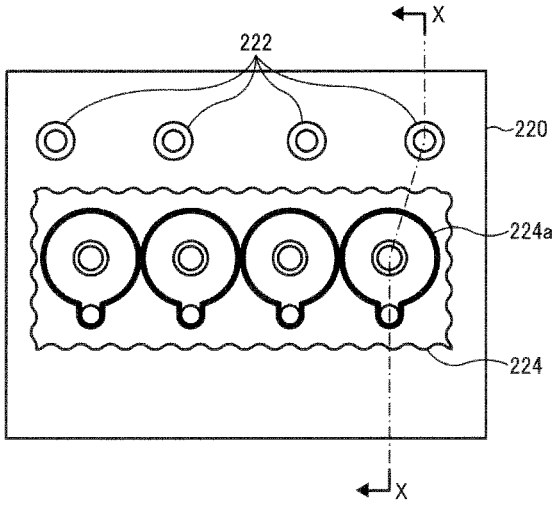
Figure 9:
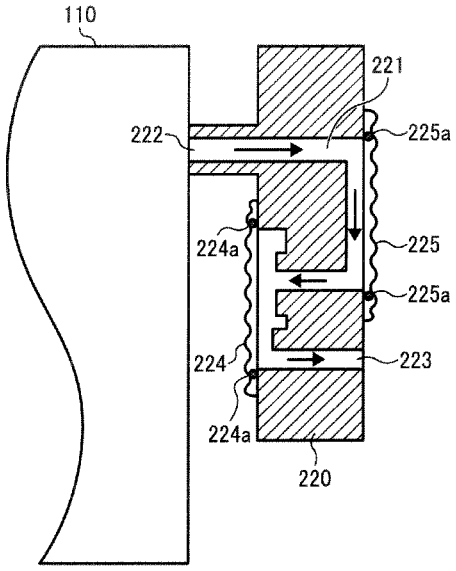
FIG. 9 is a cross-sectional view of the channel plate cut along line X-X in FIG. 8.
Figure 10:
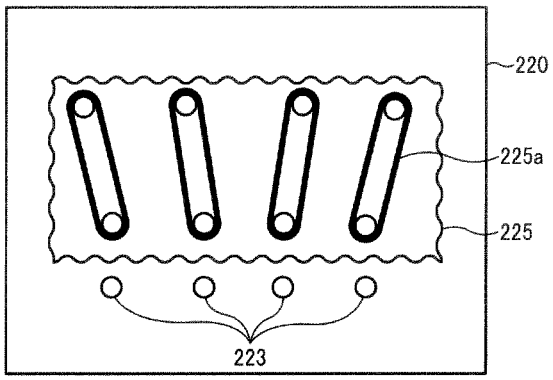
FIG. 10 is a back view of the channel plate illustrated in FIG. 8.

FIG. 8 is a front view of a channel plate 220 constituting entry channels 221 provided with the first check valve 204, seen from a side connected to an ink cartridge 110. FIG. 9 is a cross-sectional view of the channel plate 220 cut along line X-X in FIG. 8. FIG. 10 is a back view of the channel plate 220.

In a state in which the ink cartridge 110 is mounted, as illustrated in FIG. 9A, an outlet of an ink cartridge 110 is connected to an inlet 222 of the channel plate 220. The channel plate 220 includes entry channels 221 as illustrated in FIG. 9A. Ink discharged from an outlet of the ink cartridge 110 moves through an entry channel 221 in directions indicated by arrows in FIG. 9 and goes out from an outlet 223 of the channel plate 220. Ink is delivered from the outlet 223 of the channel plate 220 to the diaphragm 203*a* through entry channels of channel plates 230 and 240 (see FIGS. 11A and 11B).

Opening portions communicating the entry channel 221 are provided at the front side and the rear side of the channel plate 220, and films 224 and 225 are mounted on the channel plate 220 to cover the openings. In other words, each of the films 224 and 225 constitutes a part of a wall of the entry channel 221. The films 224 and 225 are welded to welding portions 224*a* and 224*b*, respectively, of the channel plate 220 made of resin.

Figure 11A:
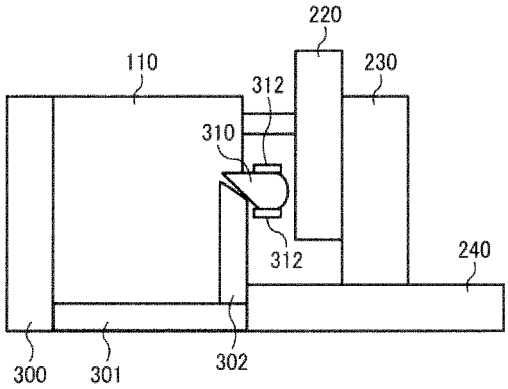
FIG. 11A is a schematic view of a liquid supplying device in a state in which a cover is closed.
Figure 11B:
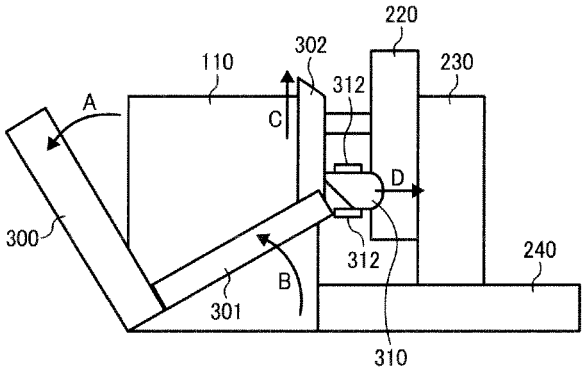
FIG. 11B is a schematic view of the liquid supplying device of FIG. 11A in a state in which the cover is open.

In at least one embodiment, the ink supplying device 124 is accommodated in a device case 126 of the inkjet recording apparatus 1. The device case 126 has an opening through which the ink cartridge 110 is inserted and removed for replacement. A cover 300 is provided to open and close the opening. In the ink supplying device 124, normally, as illustrated in FIG. 11A, the cover 300 is in a closed state. To replace the ink cartridge 110, as illustrated in FIG. 11B, the cover 300 is moved to be in an open state. Then, the empty ink cartridge 110 is removed from the opening of the device case.

In at least one embodiment, the ink supplying device 124 includes a shutter 310 to shut the entry channel 221 in accordance with movement of the cover 300 from the closed state to the open state. For example, when a user moves the cover 300 from the closed state to the open state as indicated by arrow A in FIG. 11B, a first arm 301 fixed at the cover 300 rotates as indicated by arrow B in FIG. 11B. With this rotation, an end of the first arm 301 pushes up a second arm 302 as indicated by arrow C in FIG. 11B. As a result, in a state in which the shutter 310 is guided by a guide unit 312, the shutter 310 slides toward the channel plate 220 as indicated by arrow D in FIG. 11B and moves to a shutting position.

Figure 12:
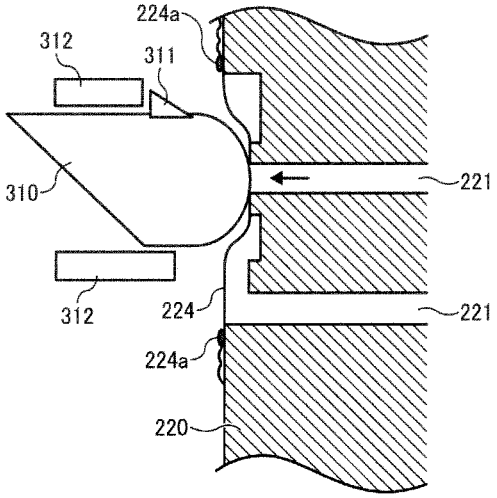
FIG. 12 is a schematic enlarged view of a state in which the entry channel is shut with a shutter having moved to a shutting position.

FIG. 12 is a schematic enlarged view of a state in which the entry channel 221 is shut by the shutter 310 moved to the shutting position.

In FIG. 12, when the shutter 310 is moved to the shutting position in accordance with movement of the cover 300 from the closed state to the open state, the film 224 serving as a displacement member constituting part of the wall of the entry channel 221. As a result, the film 224 is pushed to a position of a wall part opposing the wall part which the film 224 constitutes, thus shutting the entry channel 221. As a result, the entry channel 221 is divided at a border of the shut area of the film 224, and the side of the entry channel 221 connected to the diaphragm 203*a* is separated from the side of the entry channel 221 connected to the ink cartridge 110.

As described above, in at least one embodiment of his disclosure, when the cover 300 is moved from the closed state to the open state, the film 224 constituting part of the wall of the entry channel 221 is pressed by the shutter 310, thus shutting the entry channel 221. As a result, even when the empty ink cartridge 110 is removed, regardless of the rotation position of a cam, introduction of air into the pressurizing pump is prevented.

In at least one embodiment, the shutter 310 has a snap-fit portion 311. When the shutter 310 is moved to the shutting position at which the shutter 310 shuts the entry channel 221, the snap-fit portion 311 snap-fits the guide unit 312. As a result, until the snap-fit is released, the shutter 310 is prevented from sliding to a release position at which the shut state of the entry channel 221 is released, in other words, an open position at which the entry channel 221 is opened. Thus, the shut state of the entry channel 221 is maintained. With such a configuration, even when the cover 300 is closed with the ink cartridge 110 being removed, the shut state of the entry channel 221 is maintained, thus preventing air from being introduced into the pressurizing pump.

Figure 13A:
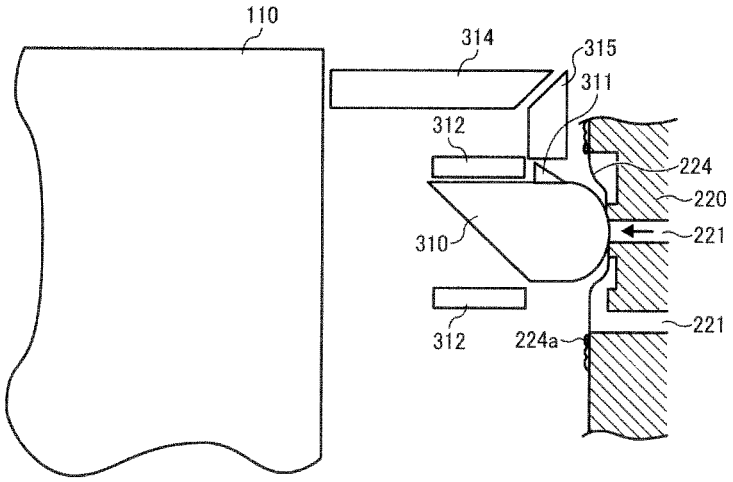
FIGS. 13A and 13B are schematic views of a configuration of releasing snap-fit of the shutter.
Figure 13B:
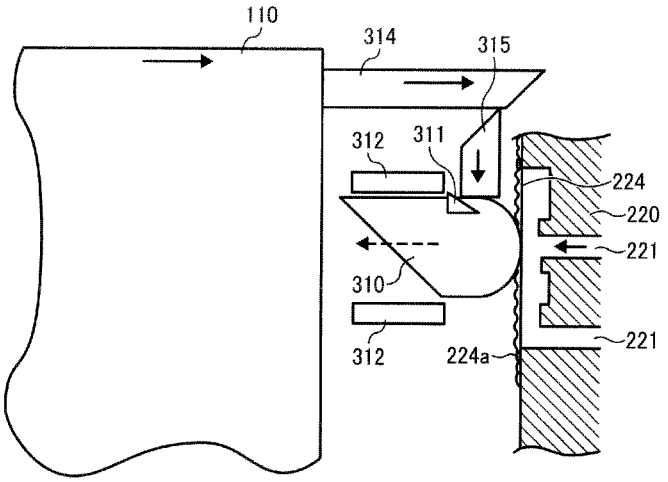

In at least one embodiment, the snap fit is released in accordance with mounting operation of the ink cartridge 110. For example, as illustrated in FIGS. 13A and 13B, when a third lever 314 is pushed in accordance with insertion of the ink cartridge 110, a fourth lever 315 pushes the snap-fit portion 311. As a result, as illustrated in FIG. 13B, the snap fit of the snap-fit portion 311 with the guide unit 312 is released, and the shutter 310 becomes movable from the shutting position to the release position. Then, when the cover 300 is moved from the open state to the closed state, the shutter 310 moves from the shutting position to the release position in accordance with the closing movement of the cover 300. As a result, the pressing of the film 224 with the shutter 310 is released, and the entry channel 221 is opened. Ink in the ink cartridge 110 flows through the entry channel 221 and can be supplied to the diaphragm 203*a*.

In some embodiments, the displacement member is a flexible member including, e.g., rubber. However, in such a configuration, due to the flexibility, the volume of the entry channel 221 may change, thus causing variation in the flow amount of ink. Hence, in at least one embodiment of this disclosure, the displacement member is the non-flexible film 224. Such a configuration suppresses a change in the volume of the entry channel 221, thus reducing variations in the flow amount of ink.

Figure 14:
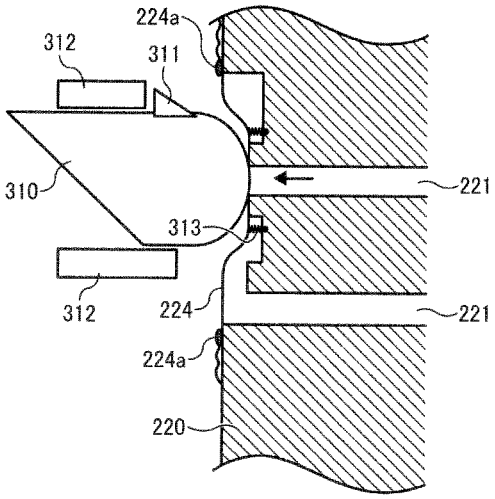
FIG. 14 is a schematic view of a configuration in which a spring is disposed in the entry channel of the channel plate to urge a film outward from the inside of the entry channel.

In some embodiments, as illustrated in FIG. 14, a spring 313 serving as an urging member is located in the entry channel 221 of the channel plate 220 to urge the film 224 outward from the inside of the entry channel 221. Providing the spring 313 prevents the film 224 from shutting the entry channel 221 when the entry channel 221 is not shut with the film 224 pressed by the shutter 310.

Figure 15:
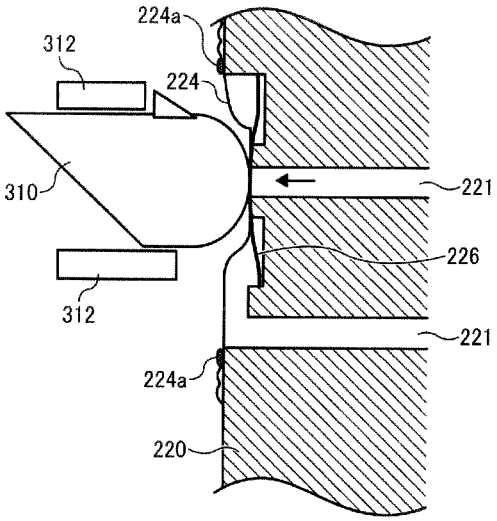
FIG. 15 is a schematic view of a configuration in which a check valve is disposed at a channel portion in the channel plate against which the film is pressed by the shutter.

In some embodiments, as illustrated in FIG. 15, a cheek valve 226 is located at a channel portion of the channel plate 220 against which the film 224 is pressed by the shutter 310. Such a configuration utilizes a channel shutting function of the check valve 226 to shut the entry channel 221, thus allowing more stable shutting.

The above descriptions relate to limited examples and embodiments of this disclosure are not limited to the above-described examples. For example, embodiments of this disclosure have the following aspects and advantages.

(Aspect A)

A liquid supplying device, such as the ink supplying device 124, includes a pump, such as the diaphragm pump 201, to suck liquid, such as ink, from a liquid storage unit, such as the ink cartridge 110, by decreasing the volume of a liquid container, such as the diaphragm 203*a*, and to supply liquid in the liquid container to a liquid supply target, such as the head tank 135, by increasing the volume of the liquid container. The liquid supplying device includes an operation member, such as the cover 300, which a user can operate, an entry channel, such as the entry channel 221, to connect the liquid storage unit and the liquid container, and a shutter, such as the shutter 310, to move with movement of the operation member to shut the entry channel. For the liquid supplying device, when a user operates the operation member in removing the liquid storage unit, the shutter moves with the movement of the operation member to shut the entry channel. Thus, a flow of liquid from the entry channel to the liquid storage unit is stopped, thus preventing an increase in the volume of the liquid container. As a result, even when the liquid storage unit is removed, air is not introduced from the entry channel to the liquid container by a volume increase of the liquid container. Using the shutter to move with the operation member to shut the entry channel obviates, e.g., an expensive sensor or a complex configuration or control. Thus, the above-described configuration prevents air from being introduced into the liquid container of the pump when an empty liquid cartridge is removed.

(Aspect B)

In the above-described aspect A, the operation member is a cover, such as the cover 300, of a device case, such as the device case 126. The shutter moves with movement of the cover from a closed state to an open state, to shut the entry channel. In such a configuration, when a user moves the cover from the closed state to the open state to remove the liquid storage unit, the entry channel is shut with the movement of the cover. Thus, without forcing the user to do a special operation, the entry channel can be shut.

(Aspect C)

In the above-described aspect A or B, the above-described pump includes a first check valve, such as the first check valve 204, to move the liquid in the entry channel only forward from the liquid storage unit to the liquid container and prevents the liquid from moving in reverse from the liquid container to the liquid storage unit, a second check valve, such as the second check valve 205, to move the liquid in an exit channel, such as the exit channel 231, to connect the liquid container and the liquid supply target in the forward direction from the liquid container to the liquid supply target and prevents the liquid from moving in the reverse direction opposite to the single direction, and a volume adjuster, such as the pressing member 206, to increase and decrease an internal volume of the liquid container. Such a configuration can employ, e.g., a diaphragm pump as the pump.

(Aspect D)

In any one of the above-described aspects A, B, and C, a part of a wall of the entry channel, such as the entry channel 221, is constituted of a displacement member, such as the film 224, displaceable between a shutting position at which the entry channel is shut and a release position at which the entry channel is open. With movement of the operation member, the shutter moves the displacement member to the shutting position to shut the entry channel with the displacement member. Such a configuration allows implementation of the shutter at relatively low cost.

(Aspect E)

In the above-described aspect D, the displacement member includes a non-flexible member, such as the film 224, to close an opening of a wall of the entry channel. As compared with a case in which a flexible member made of, e.g., rubber, is employed as the displacement member, such a configuration can more effectively suppress a change in volume of the entry channel which may be caused by a change in flexibility due to an environmental change, and suppress variation in flow amount of liquid flowing through the entry channel, thus allowing more stable liquid supply.

(Aspect F)

In the above-described Aspect D or E, the above-described shutter has an urging unit, such as the spring 313, to urge the displacement member outward from the inside of the entry channel. Such a configuration suppresses a situation in which the displacement member shuts the entry channel, such as the entry channel 221, when the entry channel 221 is not shut with the shutter, thus allowing more stable liquid supply.

(Aspect G)

In any one of the above-described aspects D, E, and F, the entry channel includes a check valve, such as the check valve 226, to move liquid in the entry channel in a forward direction from the liquid storage unit to the liquid container and to prevent the liquid from moving in a reverse direction opposite the forward direction. With movement of the operation member, the shutter moves the displacement member to the shutting position to press the check valve, such as the check valve 226, with the displacement member, thus shutting the entry channel with the check valve. Such a configuration utilizes a channel shutting function of the check valve, such as the check valve 226, to shut the entry channel, such as the entry channel 221, thus allowing more stable shutting state.

(Aspect H)

In any one of the above-described aspects A through G, the liquid supplying device, such as the ink supplying device 124, includes a stopper, such as the snap-fit portion 311, to prevent the entry channel from being open when the liquid storage unit is not connected to the liquid container. Such a configuration prevents the entry channel from being open in a state in which the liquid storage unit not connected to the liquid container, thus suppressing introduction of air into the liquid container.

(Aspect I)

In the above-described aspect H, the shutter opens the entry channel with a movement of the liquid storage unit for connecting the liquid container. Such a configuration allows the entry channel to be open when the liquid storage unit is connected to the liquid container. Thus, liquid in a new liquid storage unit is supplied to the liquid container while preventing introduction of air into the liquid container.

(Aspect J)

An image forming apparatus, such as the inkjet recording apparatus 1, includes a liquid discharge head, the print head 134, to discharge liquid droplets, such as ink droplets, onto a recording medium, such as a sheet of paper 142, to form an image on the recording medium. The image forming apparatus includes the liquid supplying device according to any one of the above-described aspects A through I to supply liquid, such as ink, in the liquid storage unit, such as the ink cartridge 110, to the liquid ejection head. Such a configuration realizes an image forming apparatus capable of preventing air from being introduced into the liquid container of the pump when an empty liquid storage unit is removed.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid supplying device, comprising:

a pump including a deformable liquid container to store liquid, the pump configured to suck liquid from a liquid storage unit to the liquid container by increasing volume of the liquid container and supply the liquid from the liquid container to a liquid supply target by decreasing the volume of the liquid container;

an operation member to be operated by a user;

an entry channel to connect the liquid storage unit and the liquid container; and a shutter to move with movement of the operation member to shut the entry channel, wherein the entry channel of the liquid supplying device has a wall including a displacement member displaceable between (i) a shutting position at which the displacement member shuts the entry channel to prevent flow of liquid from the liquid storage unit into the liquid container of the liquid supplying device and (ii) a release position at which the displacement member releases shutting of the entry channel to permit the flow of liquid from the liquid storage unit into the liquid container of the liquid supplying device, and the shutter is configured to move the displacement member to the shutting position with movement of the operation member to shut the entry channel of the liquid supplying device with the displacement member and prevent flow of liquid from the liquid storage unit into the liquid container of the liquid supplying device.

2. The liquid supplying device according to claim 1, further comprising a device case to accommodate the liquid supplying device, wherein the operation member is a cover to cover the device case, and the shutter is configured to move with movement of the cover from a closed state in which the cover covers the device case to an open state in which the cover opens the device case, to shut the entry channel.

3. The liquid supplying device according to claim 1, further comprising an exit channel to connect the liquid container and the liquid supply target, wherein the pump includes a first check valve to move the liquid in the entry channel only forward from the liquid storage unit to the liquid container and prevent the liquid from moving in reverse from the liquid container to the liquid storage unit, a second check valve to move the liquid in the exit channel only forward from the liquid container to the liquid supply target and prevent the liquid from moving in reverse from the liquid supply target to the liquid container, and a volume adjuster to increase and decrease the volume of the liquid container.

4. The liquid supplying device according to claim 1, wherein the displacement member includes a non-flexible member arranged to close an opening of the wall of the entry channel.

5. The liquid supplying device according to claim 1, wherein the shutter includes an urging member which is disposed in the entry channel to urge the displacement member outward from inside of the entry channel.

6. An image forming apparatus, comprising:

a liquid discharge head to discharge liquid droplets onto a recording medium to form an image on the recording medium; and a liquid supplying device according to claim 5 to supply the liquid from the liquid storage unit to the liquid discharge head.

7. The liquid supplying device according to claim 1, further comprising a check valve disposed in the entry channel to move the liquid in the entry channel only forward from the liquid storage unit to the liquid container and prevent the liquid from moving in reverse from the liquid container to the liquid storage unit, wherein the shutter is configured to move the displacement member to the shutting position with movement of the operation member to press the check valve with the displacement member and shut the entry channel with the check valve.

8. An image forming apparatus, comprising:

a liquid discharge head to discharge liquid droplets onto a recording medium to form an image on the recording medium; and a liquid supplying device according to claim 7 to supply the liquid from the liquid storage unit to the liquid discharge head.

9. The liquid supplying device according to claim 1, further comprising a stopper to prevent the entry channel from being open when the liquid storage unit is not connected to the liquid container.

10. The liquid supplying device according to claim 9, wherein the stopper is configured to permit the entry channel to be opened with operation of connecting the liquid storage unit to the liquid container.

11. An image forming apparatus, comprising:

a liquid discharge head to discharge liquid droplets onto a recording medium to form an image on the recording medium; and a liquid supplying device according to claim 1 to supply the liquid from the liquid storage unit to the liquid discharge head.

* * * * *